US011801917B2

(12) United States Patent
Zhu et al.

(10) Patent No.: US 11,801,917 B2
(45) Date of Patent: Oct. 31, 2023

(54) OCEANOGRAPHIC BUOY MOORING SYSTEM AND A MIXED ROPE USED THEREFOR

(71) Applicants: SHANDONG ROPE TECHNOLOGY CO. LTD, Tai'an (CN); ROPENET GROUP CO. LTD, Tai'an (CN)

(72) Inventors: Lin Zhu, Tai'an (CN); Ming Shen, Tai'an (CN); Bingtao Song, Tai'an (CN)

(73) Assignees: SHANDONG ROPE TECHNOLOGY CO. LTD, Tai'an (CN); ROPENET GROUP CO. LTD, Tai'an (CN)

( * ) Notice: Subject to any disclaimer, the term of this patent is extended or adjusted under 35 U.S.C. 154(b) by 573 days.

(21) Appl. No.: 17/044,286

(22) PCT Filed: Jan. 20, 2020

(86) PCT No.: PCT/CN2020/073306
§ 371 (c)(1),
(2) Date: Sep. 30, 2020

(87) PCT Pub. No.: WO2021/088258
PCT Pub. Date: May 14, 2021

(65) Prior Publication Data

US 2021/0245843 A1 Aug. 12, 2021

(30) Foreign Application Priority Data

Nov. 5, 2019 (CN) ..... 201911072455.3

(51) Int. Cl.
*B63B 22/04* (2006.01)
*B63B 21/20* (2006.01)
(Continued)

(52) U.S. Cl.
CPC ..... *B63B 22/04* (2013.01); *B63B 21/20* (2013.01); *D07B 1/005* (2013.01); *D07B 1/0686* (2013.01);
(Continued)

(58) Field of Classification Search
CPC ... B63B 21/20; B63B 2021/203; B63B 22/04; B63B 2022/006; D07B 1/005;
(Continued)

(56) References Cited

U.S. PATENT DOCUMENTS 6,039,325 A * 3/2000 Steinetz ..... F16J 15/121 277/528
8,695,317 B2 4/2014 Erlendsson et al.

FOREIGN PATENT DOCUMENTS

CN 2257830 Y 7/1997
CN 1580386 A 2/2005
(Continued)

OTHER PUBLICATIONS

International Search Report issued in corresponding International Application No. PCT/CN2020/073306; dated Jul. 2, 2020; 7 pgs.
(Continued)

*Primary Examiner* — Ajay Vasudeva
(74) *Attorney, Agent, or Firm* — HAUPTMAN HAM, LLP

(57) ABSTRACT

A mixed rope used for oceanographic buoy mooring system, comprises mixed core rope of metal and fiber and cover rope, wherein, the mixed core rope of metal and fiber comprises metal coil spring and fiber supporting core inside the metal coil spring; the cover rope is woven of several number of twisted strand; the mass content of the mixed core rope of metal and fiber is not greater than 20% of the mass of mixed rope, the mass content of the cover rope is not less than 80% of the mass of the mixed rope. Mixed rope used
(Continued)

for oceanographic mooring system disclosed in present embodiments has small linear density and high fracture strength, may be used as data communication channel from under-water sensor to the over-water receiver, being soft, light and easy to deploy, the mixed rope can be used as the upper part of the oceanographic buoy mooring system with prospective application.

20 Claims, 2 Drawing Sheets

(51) Int. Cl.
*D07B 1/00* (2006.01)
*D07B 1/06* (2006.01)

(52) U.S. Cl.
CPC .. *B63B 2021/203* (2013.01); *D07B 2201/102* (2013.01); *D07B 2501/2061* (2013.01)

(58) Field of Classification Search
CPC ..... D07B 1/02; D07B 1/06; D07B 1/0606; D07B 1/0613; D07B 1/062; D07B 1/0633; D07B 1/064; D07B 1/0666; D07B 1/068; D07B 1/0686; D07B 1/147; D07B 1/16; D07B 1/162; D07B 2201/102; D07B 2201/104; D07B 2201/1096; D07B 2201/2047; D07B 2201/2051; D07B 2201/2052; D07B 2201/2055; D07B 2201/2061; D07B 2201/2067; D07B 2201/2069; D07B 2501/2061
See application file for complete search history.

(56) References Cited

FOREIGN PATENT DOCUMENTS

| | | | |
|---|---|---|---|
| CN | 200971449 | Y | 11/2007 |
| CN | 108708201 | A | 10/2018 |
| CN | 108951238 | A | 12/2018 |
| JP | H0742310 | A | 2/1995 |

OTHER PUBLICATIONS

Written Opinion of the International Searching Authority issued in corresponding International Application No. PCT/CN2020/073306; dated Jul. 2, 2020; 8 pgs.

* cited by examiner

OCEANOGRAPHIC BUOY MOORING SYSTEM AND A MIXED ROPE USED THEREFOR

RELATED APPLICATIONS

The present application is a National Phase of International Application Number PCT/CN2020/073306 filed Jan. 20, 2020 and claims priority to Chinese Application Number 201911072455.3 filed Nov. 5, 2019.

TECHNICAL FIELD

This application relates to fiber rope technical field, specifically, relating to an oceanographic buoy mooring system and the mixed rope used therefor.

BACKGROUND ART

Oceanographic buoy, based on its long period, continuous and unattended observation, has found its broad application and become a vital means for ocean observation.

Mooring system is important part of the oceanographic buoy, for example, mooring system of deep ocean observation buoy lasts to several kilometers, in order to control the weight of the mooring system, in prior art, mooring system employs the chain-rope mixture structure, which includes steel chain as its lower part, fiber rope as its middle part, and steel cable as its upper mooring part. Usually the upper mooring part means the part just 0~1000 m deep under the water surface. Generally the shallow sea oceanographic buoy mooring system also employs the chain-rope mixture structure, which includes steel chain as its lower part, and steel cable as its upper mooring part.

Generally plastic coated steel cable is used as the steel cable to form the upper mooring part of the mooring system. The plastic coated steel cable plays three roles, the first of which is to anchor the buoy, the second, to hang the sensors that measure under-water data on it, the third, as a data communication channel from under-water sensors to the over-water receiver.

Terminal end of the plastic coated steel cable are exposed in the sea water and used as electrodes, with the seawater being electrical conductivity, the plastic coated steel cable and the seawater together perform as a complete circuit, acting as data communication channel; with the electromagnetic coupling effect of the coupling coil of the under-water sensor and the over-water receiver, the data communication between the under-water sensor and the over-water receiver can be completed.

However, the plastic coated steel cable used in prior art as mooring cable in the oceanographic buoy mooring system is heavy, rigid, too large to be taken in, hard to deploy, severely hindering its application in a larger scale.

DESCRIPTION

In order to solve at least one of the problems, in one aspect, some embodiments of present disclosure provide a mixed rope used for oceanographic buoy mooring system, the mixed rope comprising mixed core rope of metal and fiber and cover rope, wherein, the mixed core rope of metal and fiber comprises metal coil spring and fiber supporting core inside the metal coil spring; the cover rope is woven of several twisted strands; the mass content of the mixed core rope of metal and fiber is not greater than 20% of the mass of mixed rope, the mass content of the cover rope is not less than 80% of the mass of the mixed rope.

Some embodiments provide a mixed rope used for oceanographic buoy mooring system, wherein, the metal coil spring is made of metal wire, which is coated by plastic electrical insulation layer.

Some embodiments provide a mixed rope used for oceanographic buoy mooring system; the plastic electrical insulation layer coated outside the metal wire includes polyethylene, chlorinated polyethylene and polyvinyl chloride.

Some embodiments provide a mixed rope used for oceanographic buoy mooring system, wherein, the inner diameter of the metal coil spring is less than 25% of the diameter of the mixed rope.

Some embodiments provide a mixed rope used for oceanographic buoy mooring system, wherein, the fiber supporting core and the cover rope are made of fiber of the same material.

Some embodiments provide a mixed rope used for oceanographic buoy mooring system, wherein, the cover rope is woven of the same quantity of Z twisting direction strands and S twisting direction strands.

Some embodiments provide a mixed rope used for oceanographic buoy mooring system, wherein, the quantity of the strand of the cover rope is 8, 12 or 24.

Some embodiments provide a mixed rope used for oceanographic buoy mooring system, wherein, the strand of the cover rope is formed by first twisting and then second twisting of the of the fiber of cover.

Some embodiments provide a mixed rope used for oceanographic buoy mooring system, the twist of the strand of the cover rope is configured as 30~70 tm.

Some embodiments provide a mixed rope used for oceanographic buoy mooring system, wherein, the twist of the first twisting of fiber of cover is configured as 60~120 tm, and the twist of the second twisting of fiber of cover is configured as 50~110 tm.

In another aspect, some embodiments disclose an oceanographic buoy mooring system, the mooring system comprising the mixed rope used for oceanographic buoy mooring system.

Mixed rope used for oceanographic mooring system disclosed in present embodiments has small linear density and high fracture strength, may be used as data communication channel from the under-water sensor to the over-water receiver, being soft, light and easy to deploy, the mixed rope can be used as the upper part of the oceanographic buoy mooring system with prospective application.

EMBODIMENTS

Figure 1:
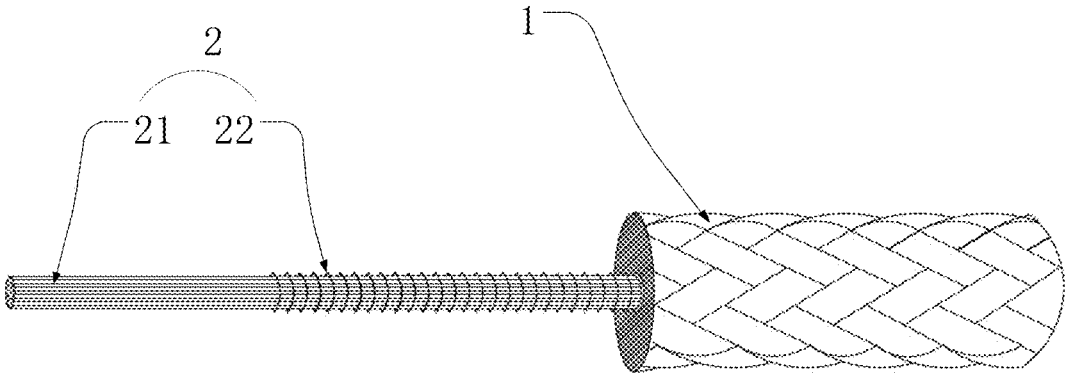
FIG. 1 is a schematic structure of the mixed rope used for oceanographic buoy mooring system.

Here in present disclosure, the expression of "embodiment", as exemplary description of any embodiment, is not necessarily explained as better or greater one than any other embodiment. Performance test is conducted using ordinary method in the art, unless expressly stated otherwise. Understandably, the expression in present disclosure is merely to explain the specific embodiment, not to limit the scope of present disclosure.

Unless stated otherwise, technical and scientific phrases in present disclosure have the same meaning that the person with ordinary skill in the art understands in ordinary way. The test methods and technical tools, not expressly stated in present disclosure, usually refer to ordinary method and tool generally used in the art.

In present disclosure, phrases, like "basically", "about", are used to describe small variation. For example, they may mean less than or equal to the variation range of ±5%, or less than or equal to the ±2%, or less than or equal to the ±1%, or less than or equal to the ±0.5%, or less than or equal to the ±0.2%, or less than or equal to the ±0.1%, or less than or equal to the ±0.05%. Quantity and other data can be expressed as range of this type. Such range expression is used only for convenience and clarity, and can be explained as not only including the figures to define the range, but also the individuals in the range, or the sub-range in the range. For example, the range of "1~5%" can be understand as including the 1%, 5% expressly listed, and individual figure, like "2%", "3.5%", "4%" and sub~range in the range, like as "1%~3%", "2%~4%", "3%~5%". The theory is also applied to range defined by one figure. Furthermore, the theory is applied to whatever data range with any width and whatever kind of characteristic.

In present disclosure, including in claims, the conjunctions, for example, "including", "comprising", "containing", "referring to", "accommodating", are explained as open expression, meaning "including but not limited to". The conjunctions "is composed of" and "consisting of" are closed expression.

In order to better illustrate the present disclosure, much more details are provided. The one with ordinary skill in the art may understand that present disclosure can be implemented without certain details. In embodiments, some methods, tools, instruments are not described in detail so as to focus on main content of present disclosure. On the premise of no conflict, the technical characteristics disclosed in present embodiments can be combined in any possible way, the new embodiment obtained accordingly still falls in the scope of present disclosure. In present disclosure, Z twisting direction or Z twisting, and S twisting direction or S twisting, are used merely to indicate two opposite direction of twisting.

In some embodiments, mixed rope used for oceanographic buoy mooring system comprises mixed core rope of metal and fiber and cover rope, wherein, the mixed core rope of metal and fiber comprises metal coil spring and fiber supporting core inside the metal coil spring; the cover rope is woven of several twisted strands; the mass content of the mixed core rope of metal and fiber is not greater than 20% of the mass of mixed rope, the mass content of the cover rope is not less than 80% of the mass of the mixed rope. Usually the strength of the mixed rope is mainly provided by the cover rope. The mixed rope can usually be used as the upper mooring part of the mooring system, which is set at a position of 0 to 1000 meters below the water surface.

Generally, in the deep sea oceanographic buoy mooring system, irrespective of tension mooring style or relaxation mooring style, the mooring fiber rope in the middle part of the mooring system has relatively large elongation rang and recoil range, so as to absorb the high energy of the wind and wave. When the buoy is propelled by heavy wind and wave, the mooring fiber rope is stretched and elongated in a large distance, the energy of the wind and wave is absorbed by the mooring fiber rope. When the wind and wave subsides, the mooring fiber rope is retracted and the buoy comes back to its original observation post. Consequently when designing and manufacturing the mixed rope used as the upper part of deep sea oceanographic buoy mooring system in present disclosure, the tensile strength and tensile stiffness of the mixed rope should be larger than that of the mooring fiber rope in the middle part of the mooring system, so as to make sure that the mixed rope used for the upper part of the mooring system will take smaller elongation, when the mooring system was stretched by relatively large pulling force of the heavy wind and wave.

In some alternative embodiments, the diameter of the fiber supporting core of the mixed core rope of metal and fiber is less than the inner diameter of the metal coil spring. As the supporting part inside the metal coil spring, the fiber supporting core can reduce the radial deformation of the spring when the mixed rope was stretched, compressed or deformed, maintaining its shape and structure, prolonging its life span. The diameter of the fiber supporting core generally is determined according to the inner diameter of the metal coin spring. The diameter of the fiber supporting core is ordinarily less than the inner diameter of the metal coil spring so that the fiber supporting core can be put adaptively inside the metal coil spring, the fiber supporting core generally can support the metal coil spring preventing being deformed severely to lose its resilience ability, without bringing about the extra resistance to affect the deformation function of the metal coil spring.

In some alternative embodiments, the fiber supporting core is formed by the bundling of synthetic fibers.

In some alternative embodiments, the fiber supporting core is formed by the weaving of synthetic fibers.

In some alternative embodiments, the fiber supporting core is formed by the weaving of several S twisting direction strands and the same number of Z twisting direction strands.

In some alternative embodiments, the strand of the fiber supporting core is formed by the first twisting and then second twisting of the fiber of core.

In some embodiments, the twist of the textile yarn of core after first twisting is set as 60~120 tm, and the twist of the rope yarn of core after second twisting is set as 50~110 tm. Here in present disclosure, tin refers to turns per meter.

In some alternative embodiments, polyester fiber, nylon, polypropylene fiber, polyethylene fiber, ultra-high molecular weight polyethylene fiber or other synthetic fiber can be selected as fiber of core rope.

In some alternative embodiments, metal coil spring is made of metal wire. Metal wire is coated by plastic electrical insulation layer and coated metal wire is formed, the coated metal wire is then wound to form metal coil spring. The material as the plastic coated outside the metal wire includes polyethylene, chlorinated polyethylene and polyvinyl chloride.

Generally the tensile stiffness of the metal coil spring made of coated metal wire is less than that of the cover rope, when the mixed rope is stretched by pulling tensile force, the metal coil spring and the cover rope are simultaneously elongated, when the pulling tensile force disappears, the metal coil spring and the cover rope and may spring back simultaneously. When deploying the mixed rope in the ocean, two ends of the metal wire forming the metal coil spring are exposed in the sea water so that the metal wire is electrically connected to water and data communication channel is formed, with the electromagnetic coupling effect between the coupling coil of the under-water sensor and the over-water receiver, data transmission between under-water sensor and the over-water receiver can be realized.

In some alternative embodiments, cylindrical stainless steel wire is selected to make metal coil spring, for example, the stainless steel wire with the diameter of 0.4~0.5 mm Cylindrical stainless steel wire usually means that the cross section of the wire is circular.

In some alternative embodiments, ribbon-type metal wire is selected to make metal coil spring. Ribbon-type metal wire is usually known as metal wire ribbon, the cross section of which has the shape of rectangle or ellipse. For example, the length of the cross section of the rectangular metal wire ribbon can be set as 0.8~1.0 mm, the width can be set as 0.3~0.4 mm. In some alternative embodiments, the electrical resistivity of the metal wire is not more than 10 Ω/m, that is, R≤10 Ω/m.

In some alternative embodiments, the inner diameter of the metal coil spring is not more than 25% of that of the mixed rope.

In some alternative embodiments, polyester fiber, nylon, polypropylene fiber, polyethylene fiber, ultra-high molecular weight polyethylene fiber or other synthetic fiber can be chosen as synthetic fiber material to weave cover rope. Generally the linear density of the cover rope can be determined according to the predetermined performance of the mixed rope.

In some alternative embodiments, the cover rope is formed by the weaving of several numbers of S twisting direction strands and the same number of Z twisting direction strands.

In some alternative embodiments, the twist of the strand of cover rope is configured as 30~70 tm.

In some alternative embodiments, the quantity of the strand for making the cover rope is set as multiple, for example, 8, 12, or 24. Usually the quantity of the Z twisting direction strand and the quantity of the S twisting direction strand is the same, and the twist is the same either.

In some alternative embodiments, the strand to form the cover rope is formed by first twisting and then second twisting of the fiber of cover.

In some embodiments, the twist of the first twisting of fiber of cover is set as 60~120 tm, the twist of the second twisting of fiber of cover is set as 50~110 tm.

In some alternative embodiments, the fiber supporting core and the cover rope are made of fibers of the same material. That is, fibers of the same material are used to manufacture the core rope and the cover rope.

Further as an alternative embodiment, fiber of the cover rope and fiber of the core rope undergoes the same first twisting and second twisting processes to serve as the cover strand and the core strand respectively.

In some alternative embodiments, oceanographic buoy mooring system includes the mixed rope used for oceanographic buoy mooring system disclosed in present embodiments.

Generally the deep sea oceanographic buoy mooring system includes steel chain as its lower part, fiber rope as its middle part and an upper mooring part. The mixed rope disclosed in present embodiments is usually used as the upper mooring part of deep sea oceanographic buoy mooring system, mainly serving the role of mooring the buoy, for the underwater sensors to hang on it and as a data communication channel from the underwater sensor to the receiver over the water.

Generally the shallow sea oceanographic buoy mooring system includes steel chain as its lower part and an upper mooring part. The mixed rope disclosed in present embodiments can be used as the upper mooring part, mainly serving the role of mooring the buoy, for the underwater sensors to hang on it, and as a data communication channel from the underwater sensors to the receiver over the water. In some embodiments, the mixed rope used for the oceanographic buoy system is manufactured according to following method, specifically the method including:

Several filaments are bundled and first twisted to form textile yarn, several textile yarns are bundled and second twisted, accordingly several Z direction twisted cover yarns and the same number of S direction twisted cover yarns are obtained respectively.

Several twisted cover yarns with the same twisting direction are bundled and twisted again, to obtain the Z direction cover strand and the same number of S direction cover strand respectively.

Several supporting core yarns are bundled to obtain the fiber supporting core.

Plastic coated metal wire to make the metal coil spring is selected.

The fiber supporting core, coated metal wire and cover strand are used to weave on the braiding machine to obtain the mixed rope.

In some embodiments, the fiber supporting core is made by core fiber being first twisted and then second twisted, and core strand being finally woven.

Following embodiments illustrate furthermore the details of present disclosure.

Embodiment 1

Figure 2:
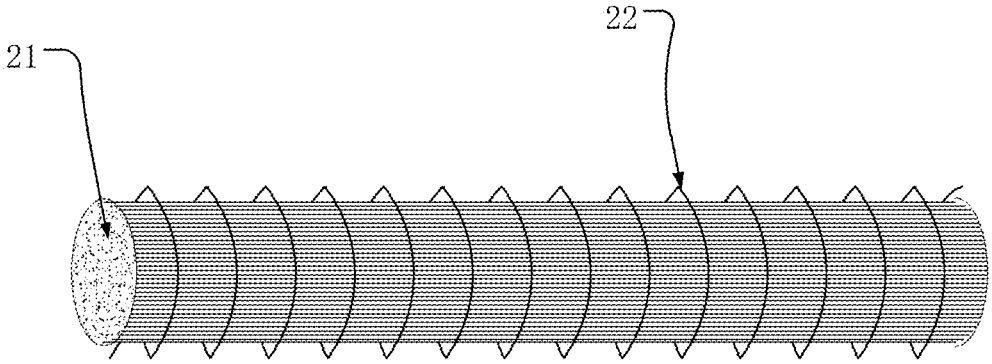
FIG. 2 is a schematic structure of mixed core of metal and fiber in mixed rope.
Figure 3:
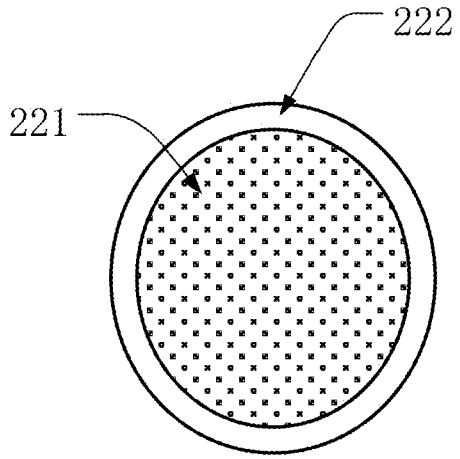
FIG. 3 is a schematic drawing of the cross sectional view of the plastic coated cylindrical metal wire used to form metal coil spring.
Figure 4:
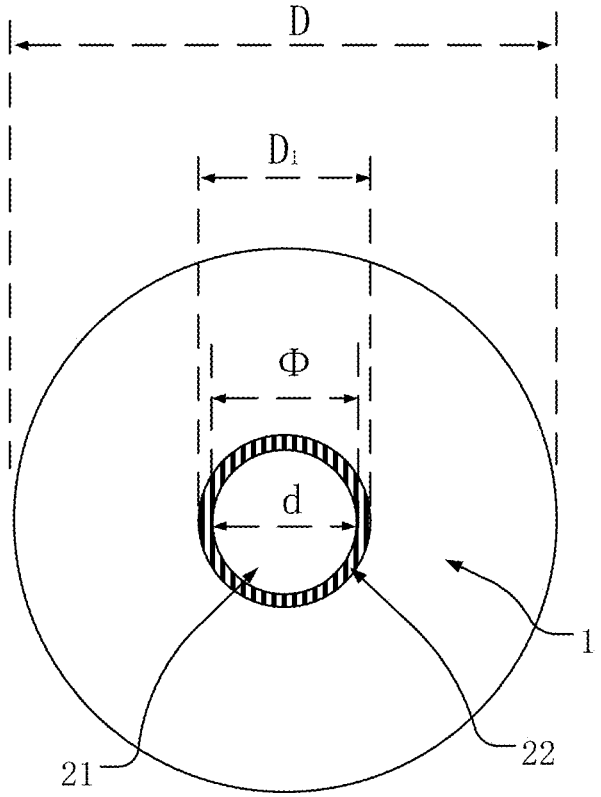
FIG. 4 is a schematic drawing of the cross sectional view of the mixed rope.

FIG. 1 is a schematic structure of the mixed rope used for oceanographic buoy mooring system. FIG. 2 is a schematic structure of mixed core of metal and fiber in mixed rope. FIG. 3 is a schematic drawing of the cross sectional view of the plastic coated cylindrical metal wire to form metal coil spring. FIG. 4 is a schematic drawing of the cross sectional view of the mixed rope.

In FIG. 1, the fiber supporting core 21 is set inside the metal coil spring 22, the fiber supporting core 21 and the metal coil spring 22 constitute the mixed core rope of metal and fiber 2, and outside the mixed core rope of metal and fiber 2 is the cover rope 1.

In FIG. 2, the fibers of core rope are bundled into one strand to form a cylindrical fiber supporting core 21. The fiber supporting core 21 is wound with a plastic coated metal wire, and the wound plastic coated metal wire forms a metal spiral spring 22. The diameter of the fiber supporting core 21 is slightly smaller than the inner diameter of the metal coil spring 22.

In FIG. 3, inside of the plastic coated metal wire is the cylindrical stainless steel wire 221, which is coated by polyethylene layer 222.

In FIG. 4, the diameter of the mixed rope is D, the inner diameter of the metal coil spring 22 is Φ, the outer diameter of the metal coil spring 22 is $D_1$, the diameter of the fiber supporting core 21 is d, wherein, Φ is not more than one quarter of D, d is smaller than Φ, the thickness of the cover rope 1 is half of the D minus $D_1$.

Embodiment 2

Mixed rope used for oceanographic buoy mooring system provided in embodiment 2 is manufactured according to following method, the method including:

Multifilament of polyamide 6 of 1260D is selected as raw material for cover rope and core rope, its tensile strength is greater than or equal to 8.5 cN/dtex, its elongation at break is 22%.

Combining 5 multi-filaments of polyamide 6 of 1260D into one textile yarn, during which the multi-filaments are first twisted with the twist of 110 tm, 3 textile yarns are bundled as one cover yarn, and the textile yarn is second twisted with the twist of 100 tm, the directions of the first twisting and second twisting both include S twisting direction and Z twisting direction respectively, S twisting direction cover yarn and Z twisting direction cover yarn are formed accordingly.

8 cover yarns are bundled as one cover strand with the structure of 7 yarns being around one yarn, that is, 7 plus 1 structure, during which, the cover yarns are twisted with the twist of 40 tm, Z twisting direction cover strand and S twisting direction cover strand are respectively obtained.

Cylindrical stainless steel wire coated with polyethylene insulation layer is selected to make metal coil spring, the diameter of the stainless steel wire is 0.5 mm, resistance R is 3.7 Ω/m, the inner diameter of the metal coil spring is 2 mm, the quality of the spring is 5.5 g per meter, that is, its linear density is 5.5 g/m.

15 multi-filaments of polyamide 6 of 1260D are bundled together as one fiber supporting core whose liner density is 2.1 g/m, diameter is 1.9 mm.

The cover rope strands are braided into 8-strand cover rope, during which, the above-mentioned fiber supporting core is fed into the central of the 8-strand braided cover rope, and the above-mentioned plastic-coated stainless steel wire is simultaneously fed into the central of the 8-strand braided cover rope, the plastic-coated stainless steel wire is moving around the fiber supporting core in the direction opposite to the spiral direction of the metal coil spring and winding around the fiber supporting core to form a mixed core rope composed of metal wire and fiber supporting core, with the pitch of the cover rope set as 70 mm, the mixed rope is finally obtained.

The diameter of the mixed rope obtained in embodiment 2 is 19.9 mm, its linear density is 183.6 g/m, and breaking strength is 81.3 KN.

Embodiment 3

Mixed rope used for oceanographic buoy mooring system provided in embodiment 3 is manufactured according to following method, the method including:

Multifilament of polyester of 2000D is selected as raw material for cover rope and, its tensile strength is greater than or equal to 8 cN/dtex, its elongation at break is 12%.

6 multi-filaments of polyester of 2000D are bundled as one textile yarn, during which, the textile yarn is first twisted with the twist of 90 tm, 3 textile yarns are bundled as one cover yarn, and the textile yarn is second twisted with the twist of 80 tm, the directions of the first twisting and second twisting both include S twisting direction and Z twisting direction respectively, S twisting direction cover yarn and Z twisting direction cover yarn are formed accordingly.

15 cover yarns are bundled as one cover strand, during which, the cover yarns are twisted with the twist of 60 tm, Z twisting direction cover strand and S twisting direction cover strand are respectively obtained. Cylindrical stainless steel wire coated with polyethylene insulation layer is selected to make metal coil spring, the diameter of the stainless steel wire is 0.4 mm, resistance R is 5.8 Ω/m, the inner diameter of the metal coil spring obtained is 2 mm, the quality of the spring is 3.96 g per meter, that is, its linear density is 3.96 g/m;

24 polyester multi-filaments of polyester of 1000D are bundled together as one fiber supporting core whose liner density is 2.7 g/m, diameter is 1.9 mm;

The cover rope strands are braided into 8-strand cover rope, during which, the fiber supporting core is fed into the central of the 8-strand braided cover rope, and the plastic-coated stainless steel wire is simultaneously fed into the central of the 8-strand braided cover rope, the plastic-coated stainless steel wire is moving around the fiber supporting core in the direction opposite to the spiral direction of the metal coil spring, and winding around the fiber supporting core to form a mixed core rope, with the pitch of the cover rope set as 125 mm, the mixed rope is finally obtained.

The diameter of the mixed rope obtained in embodiment 3 is 35.1 mm, its linear density is 602.8 g/m, and breaking strength is 130 KN.

Embodiment 4

Mixed rope used for oceanographic buoy mooring system provided in embodiment 4 is manufactured according to following method, the method including:

Multifilament of polypropylene of 840D is selected as raw material for cover rope and core rope, its tensile strength is greater than or equal to 7 cN/dtex, its elongation at break is 13%.

Combining 10 multi-filaments of polypropylene of 840D into one textile yarn, during which, the multi-filaments are first twisted with the twist of 100 tm, 3 textile yarns are bundled as one cover yarn, and the textile yarn is second twisted with the twist of 80 tm, the directions of the first twisting and second twisting both include S twisting direction and Z twisting direction respectively, S twisting direction cover yarn and Z twisting direction cover yarn are formed accordingly.

7 cover yarns are bundled as one cover strand with the structure of 6 yarns being around one yarn, that is 6 plus 1 structure, during which, the cover yarns are twisted with the twist of 50 tm, Z twisting direction cover strand and S twisting direction cover strand are respectively obtained.

Cylindrical stainless steel wire coated with polyethylene insulation layer is selected to make metal coil spring, the diameter of the stainless steel wire is 0.5 mm, resistance R is 3.7 Ω/m, the inner diameter of the metal coil spring is 2 mm, the quality of the spring is 5.5 g per meter, that is, its linear density is 5.5 g/m;

20 polypropylene multi-filaments of 840D are bundled together as one fiber supporting core whose liner density is 1.9 g/m, diameter is 1.9 mm;

The cover rope strands are braided into 12-strand cover rope, during which, the fiber supporting core is fed into the central of the 12-strand braided cover rope, and the plastic-coated stainless steel wire is simultaneously fed into the central of the 12-strand braided cover rope, the plastic-coated stainless steel wire is moving around the fiber supporting core in the direction opposite to the spiral direction of the metal coil spring, and winding around the fiber supporting core to form a mixed core rope, with the pitch of the cover rope set as 110 mm, the 12-strand mixed rope is finally obtained.

The diameter of the 12-strand mixed rope obtained in embodiment 4 is 30.1 mm, its linear density is 267.4 g/m, and breaking strength is 75 KN.

Mixed rope used for oceanographic mooring system disclosed in present embodiments have small linear density and high fracture strength, may be used as data communication channel from under-water sensor to over-water receiver. Being soft, light and easy to deploy, the mixed rope can be used as the upper part of the oceanographic buoy mooring system with prospective application.

The technique details provided in present disclosure and embodiments only serve as illustrating the inventive concept, not as limiting the scope of the technical solutions. Any change or substitute for the technique details without inventive step share the same inventive concept as present disclosure, and fall into the scope of protection the present claims sought.

The invention claimed is:

1. A mixed rope used for oceanographic buoy mooring system, wherein the mixed rope comprising mixed core rope of metal and fiber and cover rope, wherein, the mixed core rope of metal and fiber comprises metal coil spring and fiber supporting core inside the metal coil spring;

the cover rope is woven of several twisted strands; and the mass content of the mixed core rope of metal and fiber is not greater than 20% of the mass of mixed rope, the mass content of the cover rope is not less than 80% of the mass of the mixed rope.

2. The mixed rope of claim 1, wherein, the metal coil spring is made of metal wire, which is coated by plastic electrical insulation layer.

3. The mixed rope of claim 2, wherein, the fiber supporting core and the cover rope are made of fiber of the same material.

4. The mixed rope of claim 2, wherein, the cover rope is woven of the same quantity of Z twisting direction strand and S twisting direction strands.

5. The mixed rope of claim 2, wherein, the quantity of the strand of the cover rope is 8, 12 or 24.

6. The mixed rope of claim 5, wherein, the twist of the strand of the cover rope is configured as 30~70 tm.

7. The mixed rope of claim 2, wherein, the strand of the cover rope is formed by first twisting and then second twisting of the fiber of cover.

8. The mixed rope of claim 1, wherein, the inner diameter of the metal coil spring is less than 25% of the diameter of the mixed rope.

9. The mixed rope of claim 8, wherein, the fiber supporting core and the cover rope are made of fiber of the same material.

10. The mixed rope of claim 8, wherein, the cover rope is woven of the same quantity of Z twisting direction strand and S twisting direction strand.

11. The mixed rope of claim 8, wherein, the quantity of the strand of the cover rope is 8, 12 or 24.

12. The mixed rope of claim 11, wherein, the twist of the strand of the cover rope is configured as 30~70 tm.

13. The mixed rope of claim 8, wherein, the strand of the cover rope is formed by first twisting and then second twisting of the fiber of cover.

14. The mixed rope of claim 1, wherein, the fiber supporting core and the cover rope are made of fiber of the same material.

15. The mixed rope of claim 1, wherein, the cover rope is woven of the same quantity of Z twisting direction strand and S twisting direction strands.

16. The mixed rope of claim 1, wherein, the quantity of the strand of the cover rope is 8, 12 or 24.

17. The mixed rope of claim 16, wherein, the twist of the strand of the cover rope is configured as 30~70 tm.

18. The mixed rope of claim 1, wherein, the strand of the cover rope is formed by first twisting and then second twisting of the fiber of cover.

19. The mixed rope of claim 18, wherein, the twist of the first twisting of fiber of cover is configured as 60~120 tm, and the twist of the second twisting of fiber of cover is configured as 50~110 tm.

20. An oceanographic buoy mooring system, wherein, the buoy mooring system comprising the mixed rope used for oceanographic buoy mooring system according to claim 1.

* * * * *